US008704715B2

(12) United States Patent
Cheng et al.

(10) Patent No.: US 8,704,715 B2
(45) Date of Patent: Apr. 22, 2014

(54) DUAL BAND ANTENNA

(75) Inventors: Shih-Chieh Cheng, Kaohsiung (TW); Kuo-Chang Lo, Miaoli County (TW)

(73) Assignee: Arcadyan Technology Corporation, Hsinchu (TW)

( * ) Notice: Subject to any disclaimer, the term of this patent is extended or adjusted under 35 U.S.C. 154(b) by 245 days.

(21) Appl. No.: 13/277,313

(22) Filed: Oct. 20, 2011

(65) Prior Publication Data

US 2013/0016014 A1 Jan. 17, 2013

(30) Foreign Application Priority Data

Jul. 12, 2011 (TW) ..... 100124613

(51) Int. Cl.
*H01Q 1/24* (2006.01)

(52) U.S. Cl.
USPC ..... 343/702; 343/700 MS

(58) Field of Classification Search
USPC ..... 343/700 MS, 702
See application file for complete search history.

(56) References Cited

U.S. PATENT DOCUMENTS

2010/0039330 A1* 2/2010 Chien et al. ..... 343/700 MS
2010/0045564 A1* 2/2010 Chih-Yung et al. ..... 343/893

* cited by examiner

*Primary Examiner* — Dieu H Duong
*Assistant Examiner* — Hai Tran
(74) *Attorney, Agent, or Firm* — WPAT, PC; Justin King

(57) ABSTRACT

A dual band antenna with improved radiation characteristic, comprising: a ground plane, formed at the bottom thereof; two impedance matching elements formed respectively at the two arms thereof while connecting to the ground plane so as to form a first joint and a second joint at the connections in respective; a first radiation unit, connected to the first joint, being formed like an arc connected to the first joint that is disposed concave to the bottom ground plane while extending from the first joint toward the second joint, and then turning vertically upward from the end of the arc for enabling the end of the vertical portion to connect to a second radiation unit; and the second radiation unit, being formed like an arc that is disposed concave to the bottom ground plane while extending from the joint with the first radiation unit toward the first joint.

6 Claims, 8 Drawing Sheets

| Frequency(GHz) | 2.4 | 2.45 | 2.5 | 4.9 | 5.15 | 5.25 | 5.35 | 5.47 | 5.725 | 5.825 | 5.85 |
|---|---|---|---|---|---|---|---|---|---|---|---|
| Peak Gain.(dBi) | 6.42 | 6.45 | 4.95 | 1.89 | 3.21 | 4.00 | 3.36 | 6.35 | 3.96 | 3.87 | 2.72 |
| Peak Angle. | 0 | 0 | 0 | 54 | 30 | 30 | 300 | 303 | 303 | 306 | 321 |
| Min. Gain.(dBi) | -17.63 | -20.00 | -18.77 | -18.79 | -21.68 | -25.31 | -23.20 | -14.56 | -26.36 | -20.15 | -28.20 |
| Min. Angle. | 254 | 170 | 157 | 195 | 192 | 208 | 258 | 223 | 234 | 219 | 195 |
| Avg. Gain.(dBi) | -0.25 | -0.39 | -1.37 | -4.55 | -2.97 | -2.19 | -2.86 | 0.10 | -2.45 | -2.48 | -3.36 |

FIG. 9

DUAL BAND ANTENNA

FIELD OF THE INVENTION

The present invention relates to a dual band antenna with improved radiation characteristic, and more particularly, to an antenna adapted to be configured inside an electronic device under multiple layers of metallic shields that is capable of transceiving wireless signals normally and operating with good radiation characteristic.

BACKGROUND OF THE INVENTION

With rapid advance in wireless communication technology, especially in the fields of cellular phone, global positioning system and wireless network, it is more than common nowadays for use to be able to use a notebook computer with Wi-Fi capability supporting IEEE 802.11 standard for connecting to Internet wirelessly at any public area. However, in order to enable a notebook computer to have the Wi-Fi capability, it is required for the notebook computer to be configured with an antenna at two sides of its top cover panel. Nevertheless, it is noted that the wireless signal transceiving ability and quality of the antenna that is moving are directly dependent upon the structural design of the antenna. Thus, it is in need of an improved antenna that not only has good radiation characteristic and good signal transceiving stability, but also is ease to assemble.

Please refer to FIG. 1, which is a schematic diagram showing a conventional digital TV antenna. As shown in FIG. 1, the antenna 12, adapted to be disposed on a printed circuit board 11, comprises: a ground plane 121; a connection pin 122, connected to an end of the ground plane; a radiation unit 123, being formed as an U-shaped object that is connected perpendicularly to an end of the connection pin that is not connected to the ground plane; a feed point 1231, formed on the radiation unit 123 so as to be provided for a RF cable 13 to fix thereat by welding. However, it is noted that any careless movement during the assembling of the aforesaid antenna 12 that causes the radiation unit 123 to be pressed in any way will more than likely cause the radiation unit 123 to break off from the connecting with the RF cable 13 from the welding spot 131 of the feed point 1231, since the angle of the welding between the radiation unit 123 and the RF cable 13 is about 90 degrees. Such structural weakness is the major shortcoming of the aforesaid conventional antenna.

In addition, it is noted that in most conventional antennas, in order to enable the radiation unit to be disposed properly, the connection pin 122 and the ground plane 121 is usually being connected using a slim thin piece of metal, and since the radiation unit is comparatively larger in area and can easily be displaced by stress, the joint between the connection pin 122 and the ground plane 121 can easily break by stress, resulting severe damage to the antenna for preventing the same to function normally. Accordingly, it is in need of an antenna with solid structural integrity that won't break easily under any circumstance.

SUMMARY OF THE INVENTION

In view of the disadvantages of prior art, the primary object of the present invention is to provide an antenna with good radiation characteristic, capable of preventing the RF cable from breaking off from its welding point to the radiation unit of the antenna due to any careless movement in the assembling of the antenna that causes the radiation unit to be pressed in any way, as the angle of the welding between the RD cable and the radiation unit is about 180 degrees, i.e. parallel, and consequently improving the production yield of the antenna.

Another object of the invention is to provide an antenna whose connection area between its connection pin and ground plane are increased for enhancing the structural strength of the radiation unit, and thus forming an antenna with solid structural integrity.

Moreover, another object of the invention is to provide an antenna adapted to be configured inside an electronic device under multiple layers of metallic shields that is capable of transceiving wireless signals normally and operating with good radiation characteristic.

To achieve the above objects, the present invention provides a dual band antenna with improved radiation characteristic, being substantially a U-shaped flat metal piece, comprising: a ground plane, formed at the bottom thereof; two impedance matching elements formed respectively at the two arms thereof while connecting to the ground plane so as to form a first joint and a second joint at the connections in respective; a first radiation unit, connected to the first joint being formed like an arc connected to the first joint that is disposed concave to the bottom ground plane while extending from the first joint toward the second joint, and then turning vertically upward from the end of the arc for enabling the end of the vertical portion to connect to a second radiation unit; and the second radiation unit, being formed like an arc that is disposed concave to the bottom ground plane while extending from the joint with the first radiation unit toward the first joint.

Preferably, the first radiation unit is formed in a shape tapering in area by a linear manner from the portion thereof that is proximate to the first joint toward the end thereof.

Preferably, the antenna further comprises: a feed point, formed on the first radiation unit at the end thereof so as to be provided for a RF cable to connect thereat.

Preferably, the impedance matching elements are designed for protecting the first and the second radiation units.

Preferably, there is further a radiation point formed at the starting of the second radiation unit.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention and wherein:

FIG. 9 is a table of gain resulting from the antenna of the present invention.

DESCRIPTION OF THE EXEMPLARY EMBODIMENTS

For your esteemed members of reviewing committee to further understand and recognize the fulfilled functions and structural characteristics of the invention, several exemplary embodiments cooperating with detailed description are presented as the follows.

Figure 1:
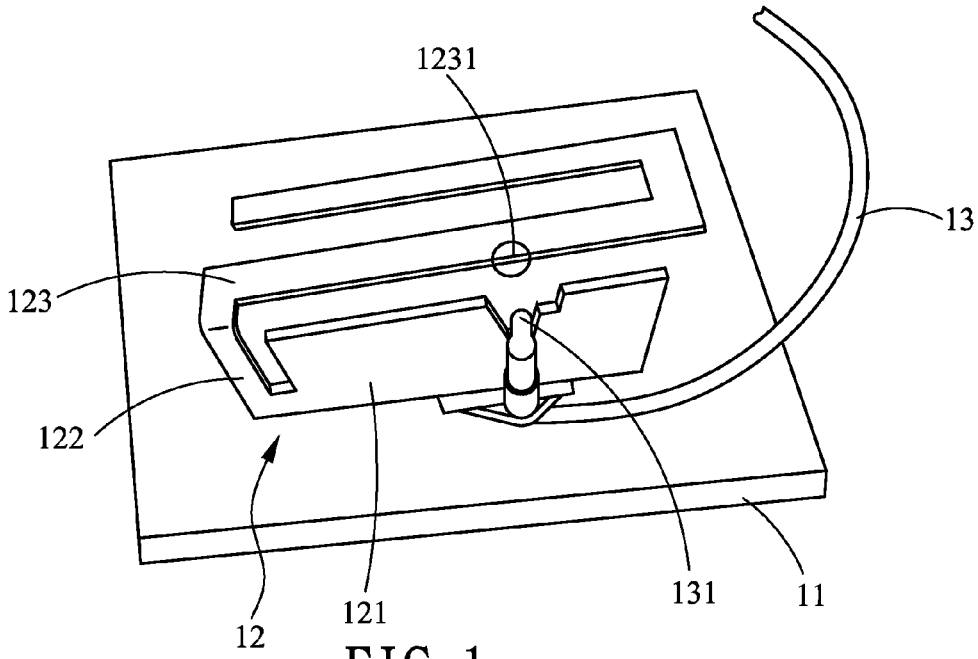
FIG. 1 is a schematic diagram showing a conventional digital TV antenna.
Figure 2:
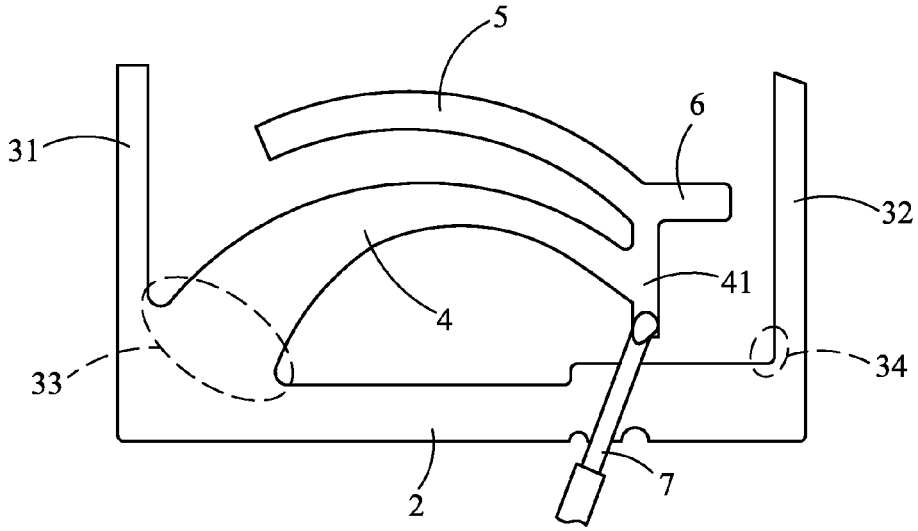
FIG. 2 is a schematic diagram showing an antenna with improved radiation characteristic according to an embodiment of the invention.
Figure 3:
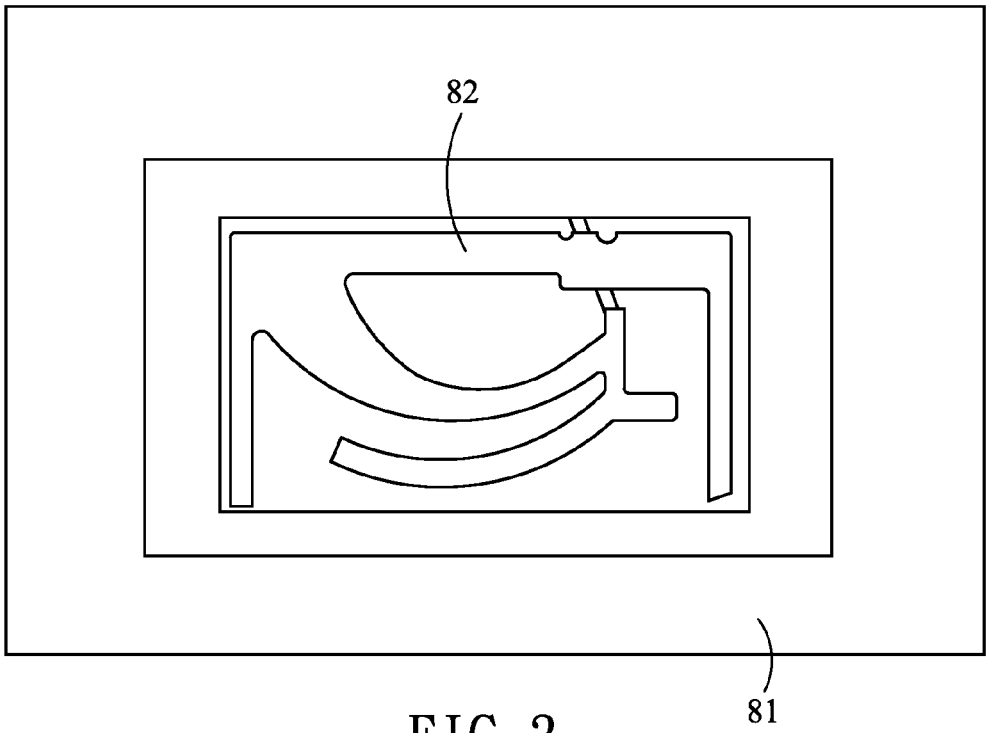
FIG. 3 is a schematic diagram showing an antenna of the present invention that is configured inside an electronic device under multiple layers of metallic shields.

Please refer to FIG. 2, which is a schematic diagram showing an antenna with improved radiation characteristic according to an embodiment of the invention. In FIG. 2, the present invention provides a dual band antenna with improved radiation characteristic, which is substantially a U-shaped flat metal piece, comprising: a ground plane 2, formed at the bottom of the U-shaped flat metal piece; two impedance matching elements 31, 32, formed respectively at the two arms of the U-shaped flat metal piece while connecting to the ground plane 2 so as to form a first joint 33 and a second joint 34 at the connections in respective; a first radiation unit 4, connected to the first joint being formed like an arc connected to the first joint that is disposed concave to the bottom ground plane 2 while extending from the first joint 33 toward the second joint 34, and then turning vertically upward from the end of the arc for enabling the end of the vertical portion to connect to a second radiation unit 5; and the second radiation unit 5, being formed like an arc that is disposed concave to the bottom ground plane 2 while extending from the connection with the first radiation unit 4 toward the first joint 33. Moreover, the first radiation unit 4 is formed in a shape tapering in area by a linear manner from the portion thereof that is proximate to the first joint 33 toward the end thereof; and the impedance matching elements are designed for protecting the first and the second radiation units. In this embodiment, the antenna further comprises: a feed point 41, formed on the first radiation unit 4 at the end thereof so as to be provided for a RF cable 7 to connect thereat while allowing another end of the RF cable 7 to connect to a print circuit board. In addition, there is further a radiation point 6 formed at the starting of the second radiation unit 34, by that the radiation characteristic of the antenna can be improved. FIG. 3 is a schematic diagram showing an antenna of the present invention that is configured inside an electronic device under multiple layers of metallic shields. As shown in FIG. 3, the antenna 82 can be configured inside an electronic device 81 under multiple layers of metallic shields and still is capable of transceiving wireless signals normally and operating with good radiation characteristic.

Figure 4:
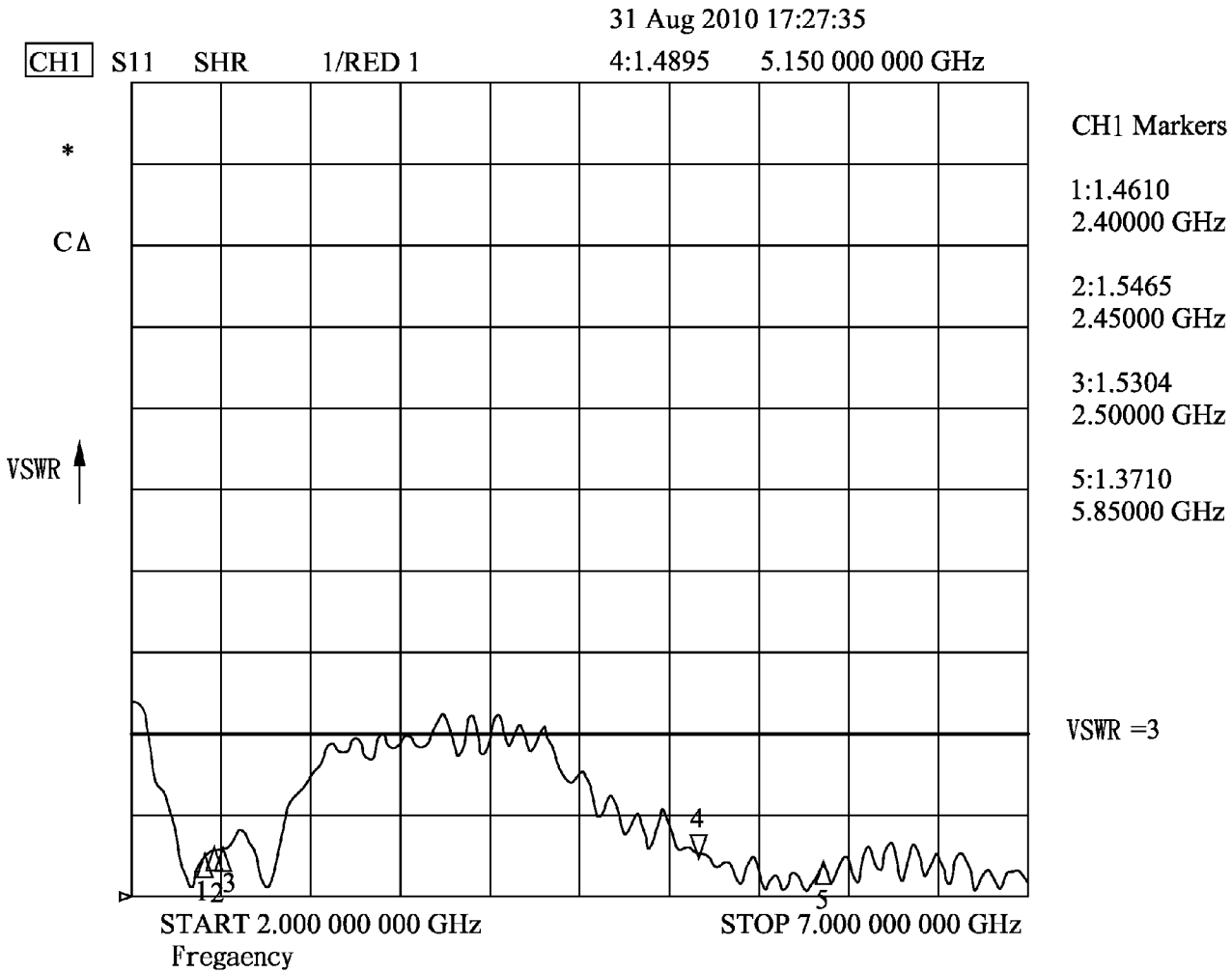
FIG. 4 is a schematic diagram showing a VSWR (voltage standing wave ratio) test result of an antenna according to the present invention.
Figure 5:
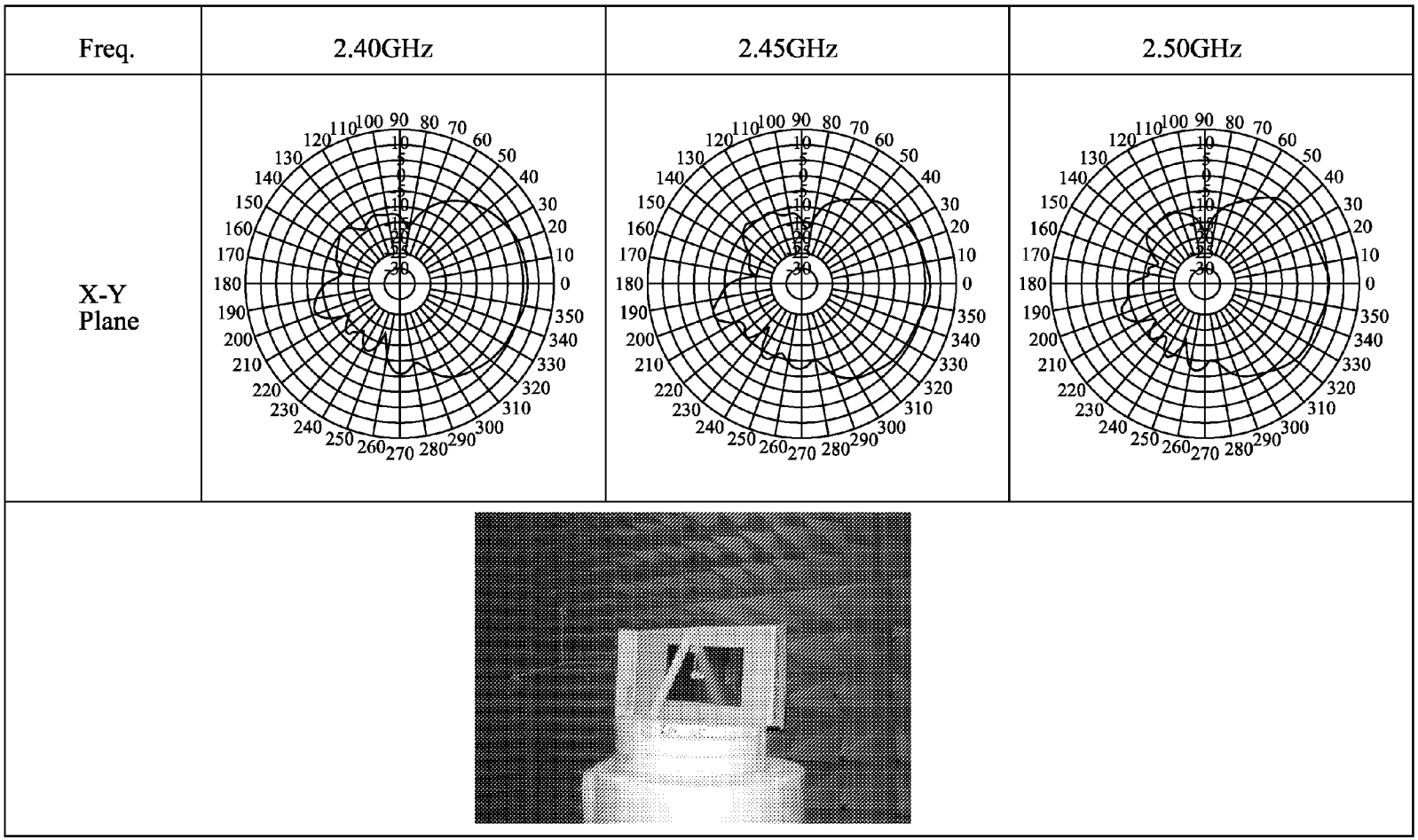
FIG. 5 is a radiation pattern of an antenna of the present invention that is operating in a frequency range between 2.4 GHz and 2.5 GHz.
Figure 6:
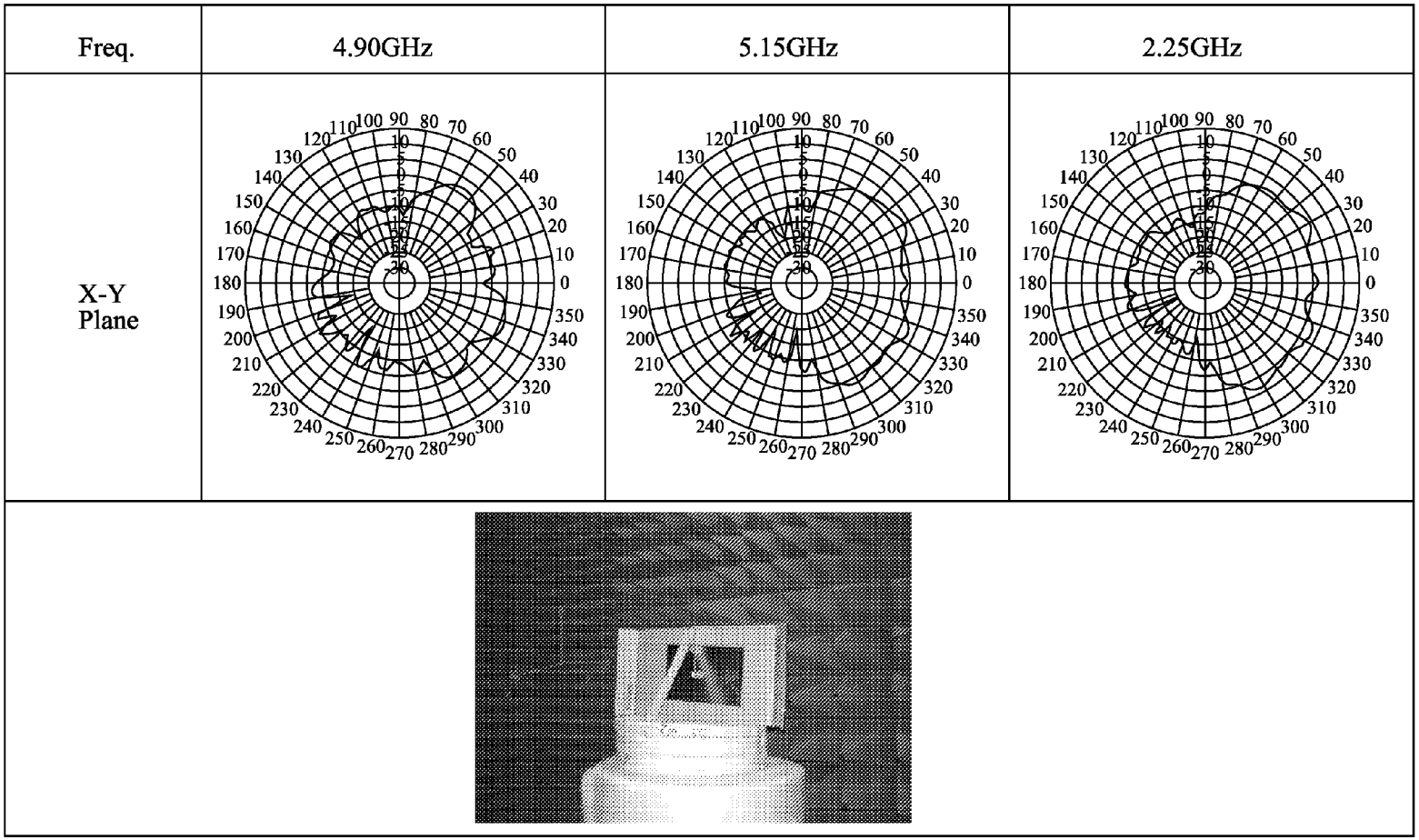
FIG. 6 is a radiation pattern of an antenna of the present invention that is operating in a frequency range between 4.9 GHz and 5.25 GHz.
Figure 7:
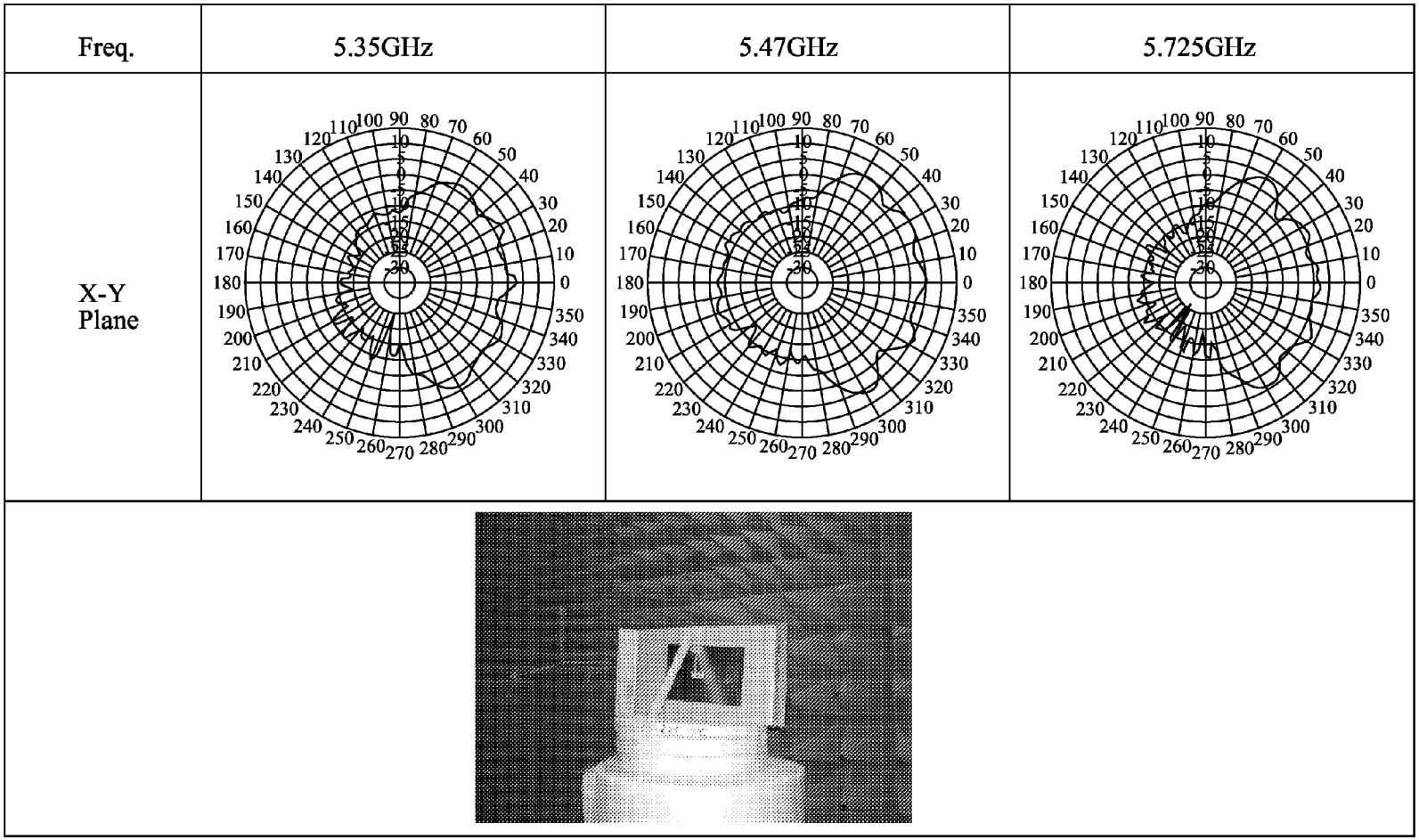
FIG. 7 is a radiation pattern of an antenna of the present invention that is operating in a frequency range between 5.35 GHz and 5.725 GHz.
Figure 8:
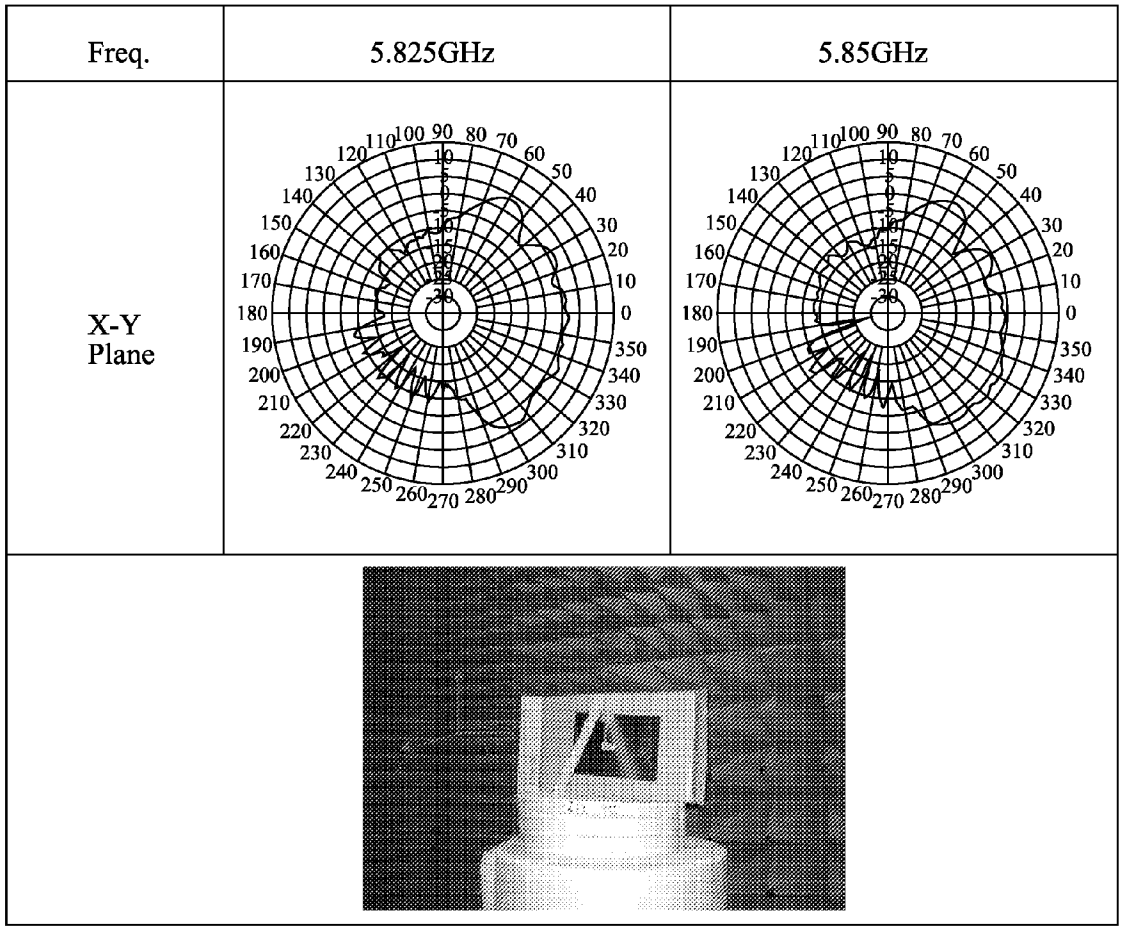
FIG. 8 is a radiation pattern of an antenna of the present invention that is operating in a frequency range between 5.825 GHz and 5.85 GHz.

Please refer to FIG. 4, which is a schematic diagram showing a VSWR (voltage standing wave ratio) test result of an antenna according to the present invention. From the test result shown in FIG. 4 where the Y axis represents the voltage standing wave ratio and the X axis represents the frequency, it is noted that the antenna that is configured inside an electronic device under multiple layers of metallic shields, can perform satisfactory in the frequency band ranged between 2.4 GHz to 5 GHz as the corresponding VSWR values are all smaller than 3, so that the antenna can be proven to have good radiation characteristic.

Please refer to FIG. 5 to FIG. 8, which are radiation patterns of an antenna of the present invention that is operating in a frequency range between 2.4 GHz and 5.85 GHz. Please refer to FIG. 9, which is a table of gain resulting from the antenna of the present invention. From the above diagrams and table, it is noted that the average gain in dBi can be maintained stably in a range between −0.25 dBi and −3.36 dBi, representing that the antenna is equipped with good radiation characteristic so as to be vastly applied in various electronic devices.

From the above description with reference to FIG. 2 to FIG. 9, the present invention can provide an antenna with good radiation characteristic, capable of preventing the RF cable from breaking off from its welding point to the radiation unit of the antenna due to any careless movement in the assembling of the antenna that causes the radiation unit to be pressed in any way, as the angle of the welding between the RD cable and the radiation unit is about 180 degrees, i.e. parallel, and consequently improving the production yield of the antenna. Moreover, not only the antenna is formed with solid structural integrity since the area of connection between its connection pin and ground plane are increased in the antenna of the invention, but also the antenna of the present invention can be configured inside an electronic device under multiple layers of metallic shields and still is capable of transceiving wireless signals normally and operating with good radiation characteristic.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

What is claimed is:

1. A flat, dual band antenna, comprising:

a ground plane;

a first impedance matching element, connecting to a first end of the ground plane at a first joint;

a second impedance matching element, connecting to a second end of the ground plane at a second joint;

a first radiation unit, comprising:

a first arc, connected to the first joint, disposed concave with respect to the ground plane, and extending from the first joint toward the second joint; and a vertical portion, connected to an end of the first arc proximal to the second joint, and extending away from the ground plane; and a second radiation unit, comprising a second arc, connected to a distal end of the vertical portion from the ground plane, disposed concave with respect to the ground plane, and extending from the distal end of the vertical portion towards the first joint, wherein the ground plane, first impedance matching unit, second impedance matching unit, first radiation unit and second radiation unit are all flat, metallic and coplanar.

2. The flat dual band antenna of claim 1, wherein said first arc has a decreasing width from said first joint to said vertical portion.

3. The flat dual band antenna of claim 1, further comprising:

a feed point, formed on said first radiation unit at said end of the first arc proximal to the second joint.

4. The flat dual band antenna of claim 1, wherein said first impedance matching element and said second impedance matching element protect said first radiation unit and said second radiation unit.

5. The flat dual band antenna of claim 1, further comprising:

a radiation point, disposed extending from an end of said second radiation unit connected to said distal end of the vertical portion from the ground plane.

6. The flat dual band antenna of claim 1, wherein said first impedance matching element, said ground plane, and said second impedance matching element are together substantially U-shaped.

* * * * *